US006398150B1

(12) United States Patent
Munter et al.

(10) Patent No.: US 6,398,150 B1
(45) Date of Patent: Jun. 4, 2002

(54) LOCKING, HAND-HELD HOLIDAY LIGHT STORAGE AND DISPENSER DEVICE

(76) Inventors: Sandra L. Munter, 1420 W. Canary Way, Chandler, AZ (US) 85248; Gregory R. Sarozek, 3420 S. 33 St., Milwaukee, WI (US) 53215; Steven R. Barnes, 2935 E Danbury Rd., Phoenix, AZ (US) 85032; Richard Riback, 1504 Greenwood Ave., Deerfield, IL (US) 60015

( * ) Notice: Subject to any disclaimer, the term of this patent is extended or adjusted under 35 U.S.C. 154(b) by 0 days.

(21) Appl. No.: 09/721,717

(22) Filed: Nov. 27, 2000

(51) Int. Cl.[7] ..... B65H 75/38

(52) U.S. Cl. ..... 242/405.2; 242/405.3; 242/588.2; 242/396.1; 242/597.6

(58) Field of Search ..... 242/405.2, 405.3, 242/588.2, 396.1, 597.6

(56) References Cited

U.S. PATENT DOCUMENTS 4,063,696 A 12/1977 Kelly et al.
4,601,440 A * 7/1986 Wang ..... 242/96
5,119,997 A 6/1992 Lee
5,445,344 A 8/1995 Seger et al.
5,526,931 A * 6/1996 White ..... 206/420
5,598,985 A * 2/1997 Winesett ..... 242/395
5,695,148 A * 12/1997 Christensen ..... 242/405.3
5,868,334 A * 2/1999 Cedillo ..... 242/405.3
5,924,570 A 7/1999 Sickles
5,927,635 A 7/1999 Black et al.
5,957,401 A 9/1999 O'Donnell

* cited by examiner

*Primary Examiner*—Donald P. Walsh
*Assistant Examiner*—Jonathan R Miller
(74) *Attorney, Agent, or Firm*—Jeffrey Weiss; Harry M. Weiss; Weiss & Moy, P.C.

(57) ABSTRACT

A locking, hand-held holiday light storage and dispenser device, comprising a base, a rotating tube coupled to the base, and a locking mechanism adapted to lock the rotating tube in position relative to the base in order to permit the storage and dispensing of holiday lights in a tangle-free manner.

13 Claims, 5 Drawing Sheets

LOCKING, HAND-HELD HOLIDAY LIGHT STORAGE AND DISPENSER DEVICE

FIELD OF THE INVENTION

This invention relates generally to holiday light storage and dispenser devices and, more specifically, to a locking, hand-held cord storage and dispenser device particularly suited for Christmas lights.

BACKGROUND OF THE INVENTION

Holiday lights are often difficult to store and dispense. The presence on a string of lights of light sockets and bulbs cause the light string to become easily tangled—making it difficult to efficiently dispense or store the lights. Untangling strings of lights can be very difficult and time-consuming.

Prior art holiday light storage and dispenser devices generally lack a locking mechanism permitting efficient dispensing and storage, and are generally not designed for efficient hand-held use. For example, U.S. Pat. No. 5,957,401 issued to O'Donnel discloses a large spool which can be attached to a ladder or other fixed object, but does not include a handle or other device to facilitate hand-held use. Additionally, the O'Donnel patent does not disclose a locking mechanism which would enable the user to start and stop the dispensing of the string of lights. Similarly, U.S. Pat. No. 5,924,570 issued to Sickles discloses a roller-type holder for holiday lights which also does not provide for a handle. The Sickles devices also lacks a locking mechanism which would allow the user to control the dispensing of the cord.

A need therefore existed for a hand-held, locking storage and dispenser device for holiday lights. The present invention satisfies this need, and provides other related advantages.

SUMMARY OF THE INVENTION

It is an object of the present invention to provide a hand-held, storage and dispenser device for holiday lights.

It is a further object of the present invention to provide a hand-held, storage and dispenser device for holiday lights that permits locking and unlocking of the device during dispensing of a string of lights or its storage.

BRIEF DESCRIPTION OF THE PREFERRED EMBODIMENTS

In accordance with one embodiment of the present invention, a locking, hand-held holiday light storage and dispenser device is disclosed. The device comprises, in combination: a base; a rotating tube rotatably coupled to the base; wherein the rotating tube is dimensioned to receive a string of holiday lights thereon; and a locking mechanism adapted to lock the rotating tube in position relative to the base.

In accordance with another embodiment of the present invention, a locking, hand-held cord storage and dispenser device is disclosed. The device comprises, in combination: a base; wherein the base comprises: a handle having a first end proximate the rotating tube and a second end distal thereto; a handle guard proximate the first end of the handle; wherein the handle guard extends three hundred sixty degrees outward from the base; and an interior shaft having a first end coupled proximate the handle guard and a second end distal thereto; a rotating tube rotatably coupled to the base; and a locking mechanism adapted to lock the rotating tube in position relative to the base.

The foregoing and other objects, features, and advantages of the invention will be apparent from the following, more particular description of the preferred embodiments of the invention, as illustrated in the accompanying drawings.

DETAILED DESCRIPTION OF THE PREFERRED EMBODIMENTS

Figure 1:
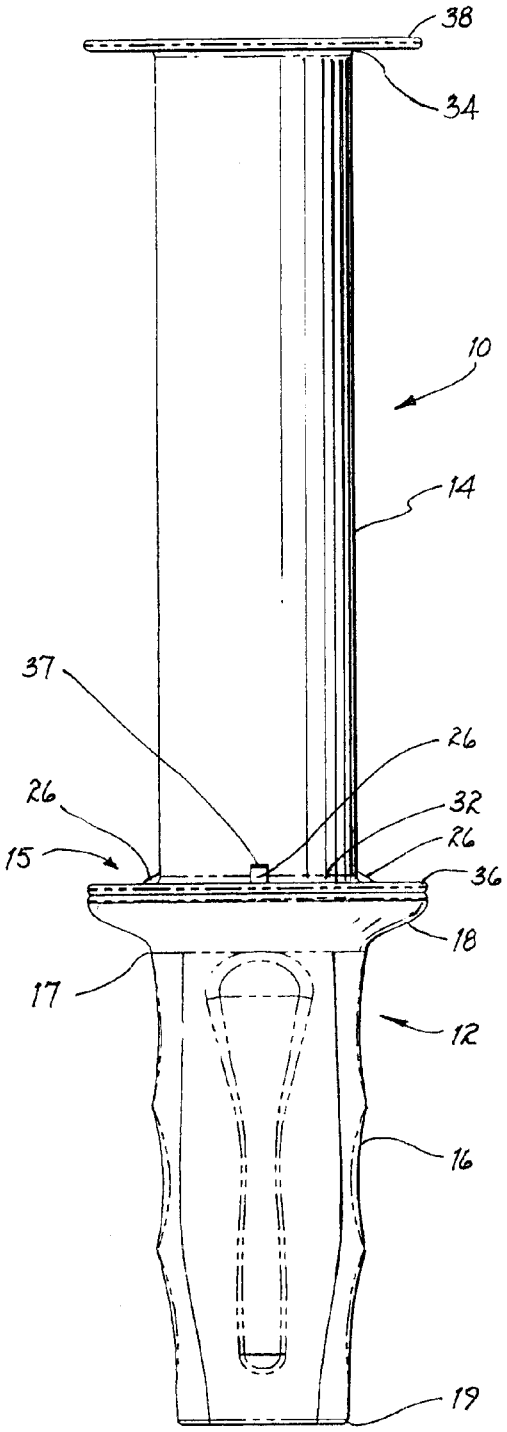
FIG. 1 is a front view of the preferred embodiment of the locking, hand-held holiday light storage and dispenser device of the present invention.
Figure 2:
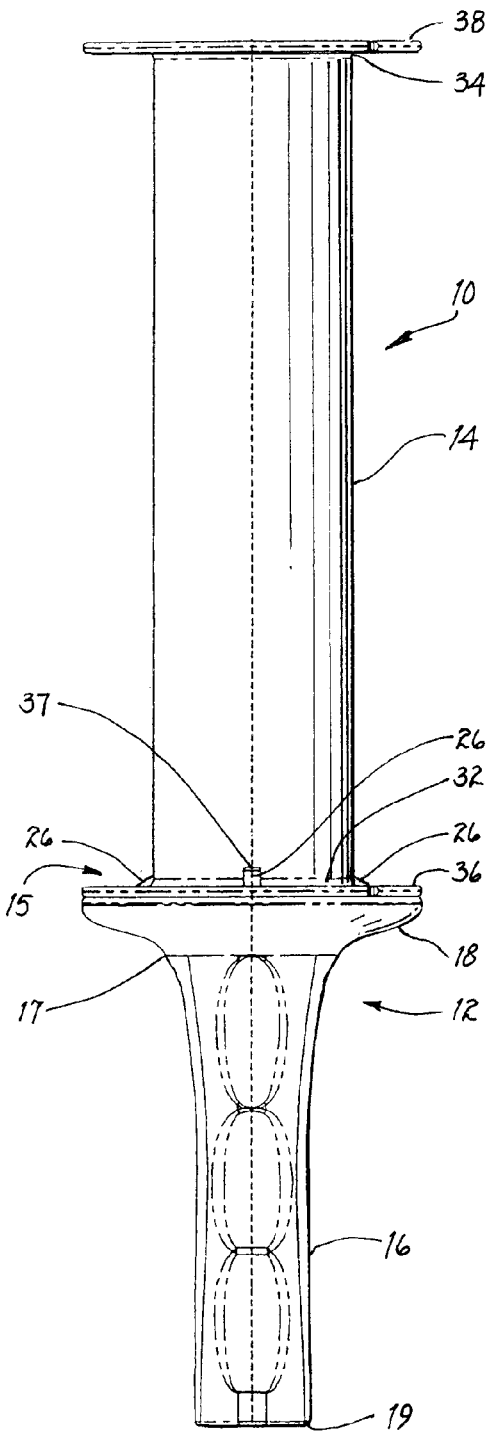
FIG. 2 is a side view of the preferred embodiment of the locking, hand-held holiday light storage and dispenser device of FIG. 1.
Figure 3:
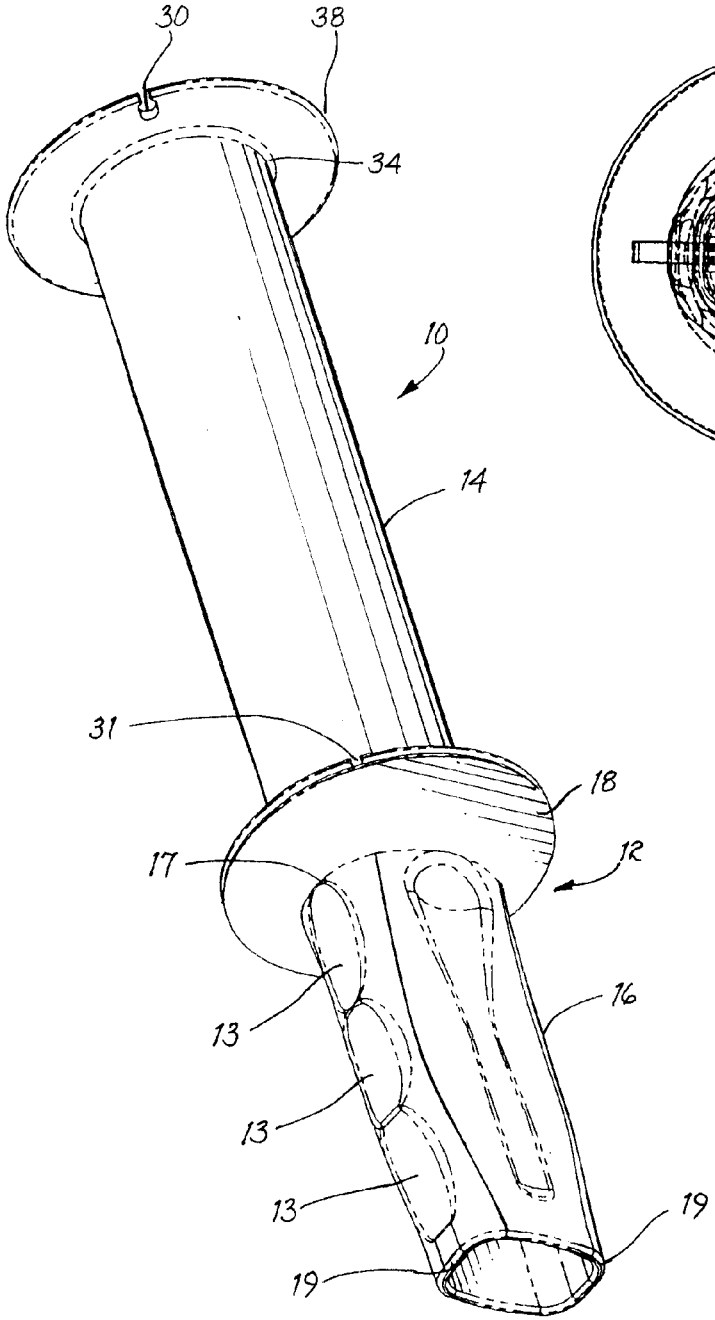
FIG. 3 is a perspective view of the preferred embodiment of the locking, hand-held holiday light storage and dispenser device of FIG. 1.
Figure 5:
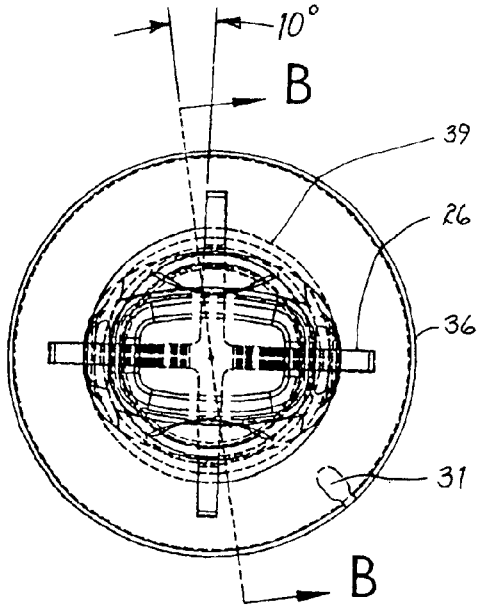
FIG. 5 is a top, cross-sectional view of the preferred embodiment of the locking, hand-held holiday light storage and dispenser device of FIG. 1.
Figure 4:
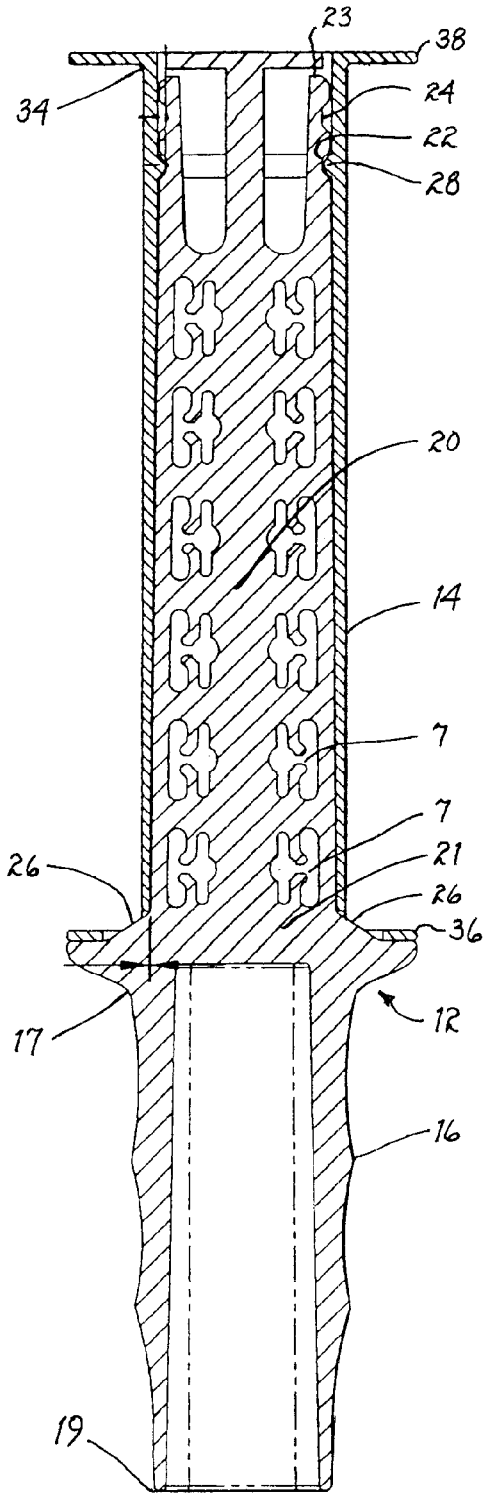
FIG. 4 is a front, cross-sectional view of the preferred embodiment of the locking, hand-held holiday light storage and dispenser device of FIG. 1.
Figure 6:
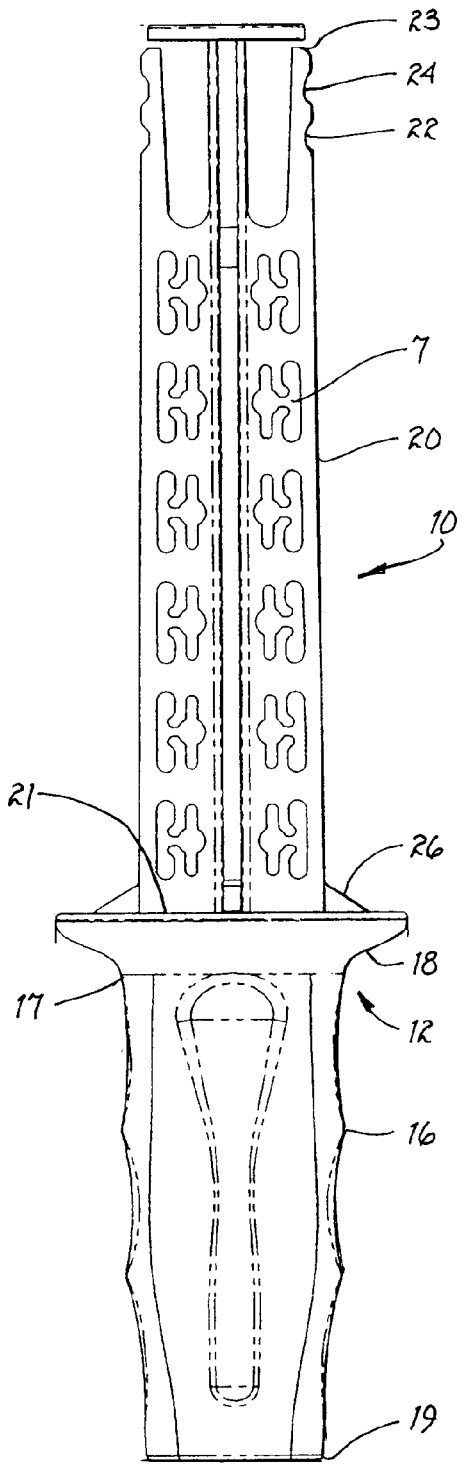
FIG. 6 is a front view of the preferred embodiment of the locking, hand-held holiday light storage and dispenser device of FIG. 1 without the rotating tube.
Figure 7:
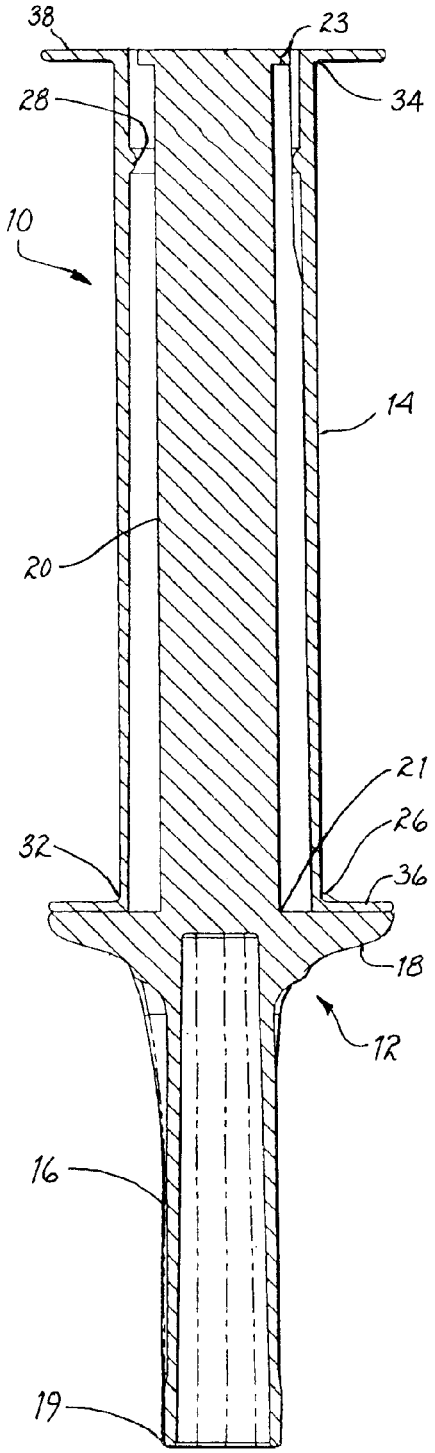
FIG. 7 is a side, cross-sectional view of the preferred embodiment of the locking, hand-held holiday light storage and dispenser device of FIG. 1.

Referring to FIGS. 1–7, reference number 10 refers generally to the preferred embodiment of the locking, hand-held holiday light storage and dispenser device of the present invention (hereinafter "device 10"). The device 10 generally comprises a base 12, a rotating tube 14, and a locking mechanism 15. The rotating tube 14 is rotatably coupled to the base 12 and the locking mechanism 15 is adapted to lock the rotating tube 14 in position relative to the base 12.

Preferably, the device 10, including each of the base 12, the rotating tube 14, and the locking mechanism 15, is constructed of molded plastic, although it should be clearly understood that substantial benefit could be derived from an alternative configuration of the device 10 which is constructed from an alternative material such as wood, metal, or any other material allowing for efficient use of the device 10. In this regard, it is further preferred that the entire base 12 as herein described, including those portions of the locking mechanism 15 located thereon, be of one-piece construction.

In the preferred embodiment, the base 12 further comprises a handle 16, having a first end 17 proximate the rotating tube 14 and a second end 19 distal thereto. As shown particularly in FIG. 3, the handle 16 preferably includes recessed regions 13 so as to make it easier to grip securely. The base 12 further preferably comprises a handle guard 18 fixedly coupled proximate the first end 17 of the handle 16. The purpose of the handle guard 18 is to shield the hand of the user from contacting the rotating first flange 36, described below. The base 12 further comprises an interior shaft 20 (shown in FIGS. 4–7) having a first end 21 proximate the handle guard 18 and a second end 23 distal thereto.

In the preferred embodiment, the interior shaft 20 is four pronged, although it should be understood that substantial benefit could be derived from an alternatively shaped interior shaft 20 so long as it could be permit the rotatable coupling and locking thereto of a rotating tube 14. Preferably, the interior shaft 20 defines a plurality of apertures 7 to reduce the overall weight of the device 10—or to be used to store replacement bulbs. In the preferred embodiment, the interior shaft 20 comprises at least one, and preferably four protrusions 26 extending away from an outer area of the interior shaft 20 proximate the handle guard 18. The protrusions 26 comprise one of the elements of the locking mechanism 15 necessary to lock the rotating tube 14 into position relative to the base 12.

Additionally, each of the four prongs of the interior shaft 20 further comprises an upper channel 24 proximate the second end 23 of the interior shaft 20 and a lower channel 22 positioned below the upper channel 24. The upper channels 24 and the lower channels 22 comprise an additional element of the locking mechanism 15 necessary to lock the rotating tube 14 into position relative to the fixed handle portion 12.

In the preferred embodiment, the rotating tube 14 has a first end 32 proximate the handle guard 18 and a second end 34 distal thereto. The rotating tube 14 preferably comprises a bead 28 (shown in FIGS. 4 and 7) disposed along an interior surface of the rotating tube 14 proximate the second end 34 of the rotating tube 14 and dimensioned to be positioned selectively within either of the upper channels 24 and the lower channels 22—thereby providing two stable positions for the rotating tube 14.

The rotating tube 14 further comprises a first flange 36 coupled to the first end 32 of the rotating tube 14. The first flange 36 defines a slotted opening 31 (shown in FIG. 3) therein along the edge of the first flange 36. The rotating tube 14 further comprises a second flange 38 coupled to the second end 34 of the rotating tube 14. The second circular flange 38 defines a slotted opening 30 (shown in FIG. 3) therein along the edge of the second flange 38. The purpose of the first flange 36 and the second flange 38 is to prevent a light string 39 (see FIG. 5), which as discussed above can be relatively heavy or bulky, from sliding off of the rotating tube 14 in either direction. A coupling end of the light string 39 could be inserted into either slotted opening 30 or slotted opening 31 to anchor one end of the light string 39 to the rotating tube 14 while the rest of the light string 39 is either spooled onto or off of the rotating tube 14. Once the light string 39 is completely spooled onto the rotating tube 14, the remaining unattached end of the light string 39 could be inserted into the available slotted opening to secure the light string 39 in place for storage.

In the preferred embodiment, the first flange 36 defines four apertures 37 (shown in FIGS. 1 and 2), each of which is dimensioned to receive a protrusion 26 to lock the rotating tube 14 in position relative to the fixed handle portion 12. Together, the apertures 37, the protrusions 26, the bead 28, the lower channels 22, and the upper channels 24 comprise the locking mechanism 15

It should be understood that alternative locking mechanisms to the locking mechanism 15 could be provided, without departing from the spirit or scope of the present invention. The only requirement is that it be possible to lock the rotating tube 14 in position or otherwise prevent the light string 39 from inadvertently deploying. For example, it would be possible to provide an opening through the rotating tube 14, and a corresponding opening through the interior shaft 20, so that the insertion of a pin or similar item through these two openings would have the effect of locking the rotating tube 14 in position relative to the shaft 20.

Figure 8:
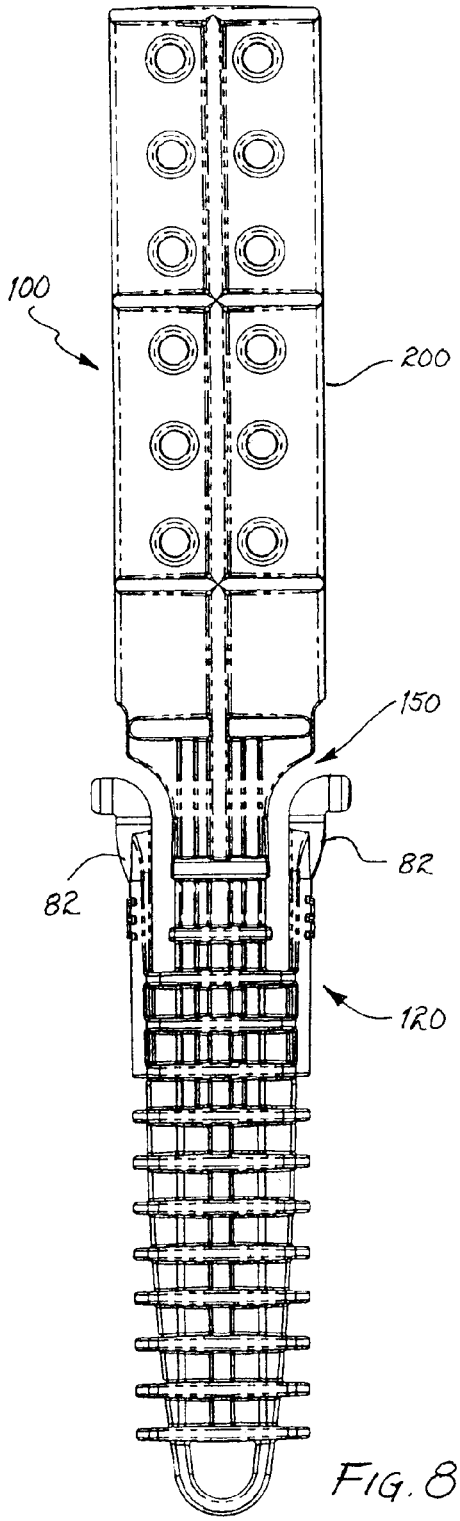
FIG. 8 is a front view of another embodiment of the locking, hand-held holiday light storage and dispenser device of the present invention.
Figure 9:
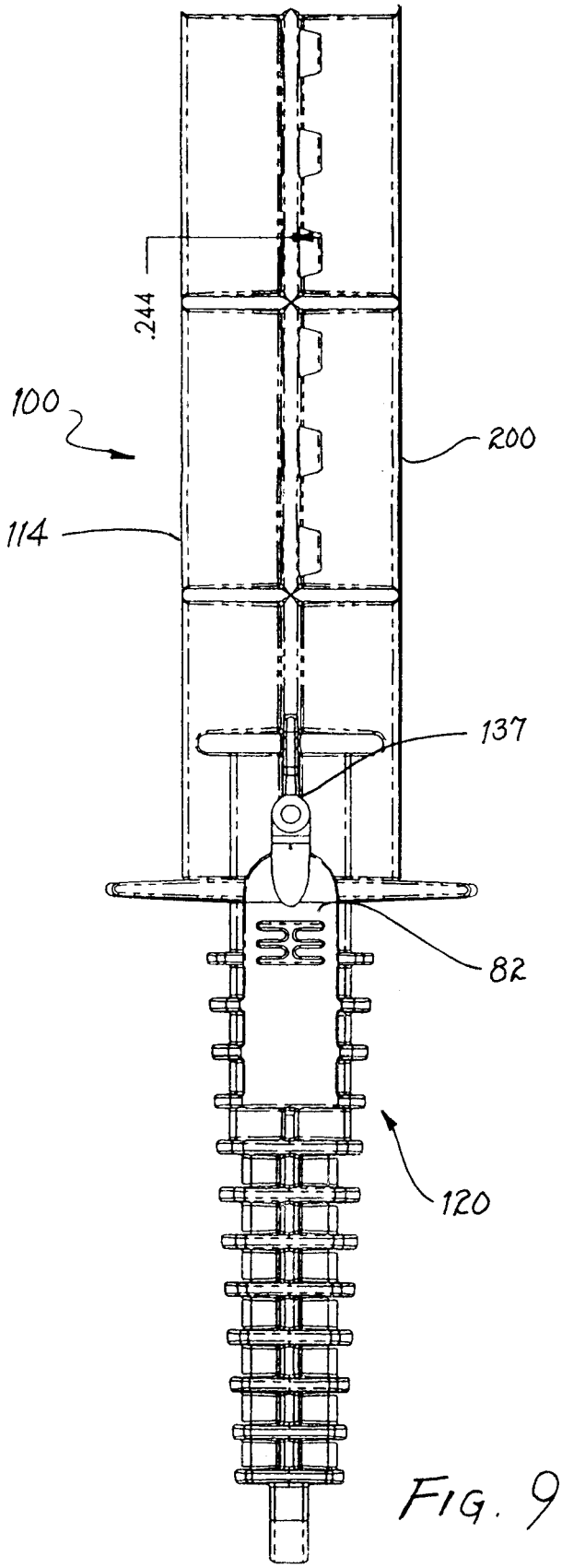
FIG. 9 is a side view of the locking, hand-held holiday light storage and dispenser device of FIG. 8.

Referring now to FIGS. 8 and 9, an alternative embodiment of the device 10, hereinafter the device 100, is shown. The device 100 is essentially the same as described above, except with respect to the locking mechanism 150. The locking mechanism 150 comprises two tabs 82 disposed on opposite sides of the base 120, proximate the rotating tube 114. The tabs 82 are dimensioned to mate with two apertures 137 in the rotating tube 114 to lock the rotating tube 114 in position relative to the base 120. This mating is caused by the depression of the tabs 82 in the direction of the base 120, causing the tabs 82 to retract and permitting the rotating tube 114 to be positioned so that the apertures 137 are aligned with the tabs 82—which tabs 82 are then released and allowed to extend through the apertures 137. To disengage the locking mechanism 150 and allow the rotating tube 114 to rotate freely about the interior shaft 200, the user again depresses the tabs 82 and then grasps the rotating tube 114 and positions the rotating tube 114 above the tabs 82.

Statement of Operation

In order to operate the device 10, a user preferably attaches an end of a light string 39 to one of the slotted openings 30 and 31. Then the user grasps the rotating tube 14 and positions it such that the bead 28 is located within the lower channels 22 and each protrusion 26 is within an aperture 37. In this position, the rotating tube 14 is locked into position relative to the interior shaft 20, and is in condition to have a light string 39 loaded thereon. (Some users may prefer to load a light string 39 with the rotating tube 14 in an unlocked position, which position is achieved as described below.) Once the light string 39 is completely spooled onto the rotating tube 14, the user may then insert the remaining unattached end of the light string 39 into the available slotted opening 30 or 31 to secure the light string 39 in place for storage.

Once the light string 39 is loaded onto the rotating tube 14 and is ready to be dispensed, the rotating tube 14 is repositioned so that the bead 28 is located within the upper channels 24. The light string 39 may then be dispensed, as desired. Where the user desires to take a break during the dispensing process, the user may relock the rotating tube 14 as described above, so as to prevent any accidental dispensing of the light string 39. When the user is ready to resume dispensing, the rotating tube 14 may be unlocked and the dispensing process re-commenced.

Operation of the device 100 is essentially the same as the operation for the device 10, except with respect to the locking mechanism, the operation of which is described above.

While the invention has been particularly shown and described with reference to preferred embodiments thereof, it will be understood by those skilled in the art that the foregoing and other changes in form and details may be made therein without departing from the spirit and scope of the invention. For example, while the device of the present invention is preferably to be used with holiday light strings, it would be possible to also use the device to store and dispense other cord-type items tending to tangle, including for example strings of icicle lights, garland and extension cords.

We claim:

1. A locking, hand-held holiday light storage and dispenser device comprising, in combination:

a base;

a string of holiday lights;

an elongated rotating tube having a first end proximate said base and a second end distal therefrom and a distance between said first end and said second end defining a length of said rotating tube and wherein said length of said rotating tube is greater than a width thereof and rotatably coupled proximate said first end to said base;

wherein said rotating tube is dimensioned to receive said string of holiday lights thereon; and a locking mechanism adapted to lock said rotating tube in position relative to said base.

2. The device of claim 1 wherein said base comprises:

a handle having a first end proximate said rotating tube and a second end distal thereto;

a handle guard proximate said first end of said handle; and an interior shaft having a first end coupled proximate said handle guard and a second end distal thereto.

3. The device of claim 2 wherein said handle guard extends three hundred sixty degrees outward from said base.

4. The device of claim 2 wherein said interior shaft is four-pronged.

5. The device of claim 2 wherein said interior shaft defines a plurality of weight-reducing apertures.

6. The device of claim 1 wherein said locking, hand-held cord storage and dispenser device is constructed of molded plastic.

7. The device of claim 1 wherein said locking mechanism comprises two tabs disposed on opposite sides of said base proximate said rotating tube, said tabs are dimensioned to mate with apertures in said rotating tube to lock said rotating tube in position relative to said base.

8. The device of claim 7 wherein said locking, hand-held cord storage and dispenser device is constructed of molded plastic.

9. A locking, hand-held holiday light storage and dispenser device comprising, in combination:

a base;

wherein said base comprises:

a handle having a first end proximate said rotating tube and a second end distal thereto;

a handle guard proximate said first end of said handle; and an interior shaft having a first end coupled proximate said handle guard and a second end distal thereto;

wherein said interior shaft is four-pronged;

wherein said four-pronged interior shaft further comprises at least one protrusion extending away from an outer area of said four-pronged interior shaft proximate said handle guard;

a rotating tube rotatably coupled to said base;

wherein said rotating tube is dimensioned to receive a string of holiday lights thereon; and a locking mechanism adapted to lock said rotating tube in position relative to said base.

10. The device of claim 9 wherein said substantially four-pronged interior shaft comprises four protrusions extending away from an outer area of said four-pronged interior shaft proximate said handle guard.

11. The device of claim 10 wherein said four-pronged interior shaft comprises one upper channel proximate said second end of said interior shaft and one lower channel positioned between said at least one upper channel and said first end of said interior shaft.

12. The device of claim 11 wherein said rotating tube having a first end proximate said handle guard and a second end distal thereto comprises:

a bead disposed along an interior surface of said rotating tube proximate said second end of said rotating tube and dimensioned to be positioned within either of said upper channel and said lower channel;

a first flange located at said first end of said rotating tube and having a slotted opening therein along the perimeter thereof; and a second flange located at said second end of said rotating tube and having a slotted opening therein along the perimeter thereof.

13. The device of claim 12 wherein said first flange defines at least one aperture dimensioned to mate with said at least one protrusion to lock said rotating tube in position relative to said base.

* * * * *